United States Patent [19]

Matsumura et al.

[11] 4,276,629

[45] Jun. 30, 1981

[54] SOLAR BATTERY TIMEPIECE

[75] Inventors: Osamu Matsumura, Choufu; Yutaka Kato, Kodaira; Tsunetoshi Sekiguchi, Sayama; Ryo Namiki, Itabashi, all of Japan

[73] Assignee: Citizen Watch Company Limited, Tokyo, Japan

[21] Appl. No.: 34,192

[22] Filed: Apr. 27, 1979

Related U.S. Application Data

[62] Division of Ser. No. 803,775, Jun. 6, 1977, Pat. No. 4,165,604.

[30] Foreign Application Priority Data

| | | | |
|---|---|---|---|
| Jun. 8, 1976 | [JP] | Japan | 51/74938 |
| Jun. 9, 1976 | [JP] | Japan | 51/73694 |
| Jul. 23, 1976 | [JP] | Japan | 51/98458 |
| Aug. 26, 1976 | [JP] | Japan | 51/113446 |
| Dec. 6, 1976 | [JP] | Japan | 51/163327 |

[51] Int. Cl.[3] ..... G04C 19/00

[52] U.S. Cl. ..... 368/86; 368/87; 368/84; 368/205; 368/218

[58] Field of Search ..... 58/23 BA, 23 R, 50 R, 58/23 C, 106.5; 136/89; 29/626, 628, 630 R; 361/400; 368/84–87, 203–205, 217–219, 242

[56] References Cited

U.S. PATENT DOCUMENTS

| | | | |
|---|---|---|---|
| 849,292 | 4/1907 | Wall et al. | 58/106.5 |
| 3,747,327 | 7/1973 | Uchiyama | 58/23 BA X |
| 3,780,519 | 12/1973 | Tokunaga | 58/23 C |
| 3,890,776 | 6/1975 | Urushida | 58/23 C |
| 3,919,836 | 11/1975 | Nishizawa | 58/106.5 |
| 4,020,627 | 5/1977 | Yoshida et al. | 361/400 |
| 4,033,111 | 7/1977 | Matsuura | 58/106.5 |

*Primary Examiner*—Ulysses Weldon
*Attorney, Agent, or Firm*—Sherman & Shalloway

[57] ABSTRACT

A solar battery timepiece has a structure of a module, a base plate on the module, a solar battery cell on the base plate, an insulating flexible sheet provided with a print wiring and interposed between the base plate and the solar battery cell, and a dial ring attached to the peripheral edge of the base plate whereby the solar battery timepiece may be made with a reduced thickness, small in size, simple in construction, shock resistant and reliable in operation.

4 Claims, 14 Drawing Figures

SOLAR BATTERY TIMEPIECE

This is a division of application Ser. No. 803,775 filed on June 6, 1977 now U.S. Pat. No. 4,165,604 issued on Aug. 28, 1979.

This invention relates to a timepiece driven by a solar battery and more particularly to an arrangement and connection of the solar battery.

Heretofore, it has been the common practice to construct a dial plate as follows. Shown in FIG. 1, on the upper surface of a module or movement 1 is arranged a base plate 3 to the upper surface of which is secured an insulating flexible sheet 4 provided thereon with a wiring pattern 4*a* for electrically connecting a plurality of solar battery cells 5 to the module 1, the flexible sheet 4 being provided thereon with the above mentioned solar battery cells 5 and a dial frame 6, thus constituting a dial plate 2. The solar battery cell 5 is generally formed of a silicon monocrystal so that even when a slight deformation occurs in the solar battery cell 5 due to shock the solar battery cell 5 becomes damaged easily. In order to prevent the solar battery cell from being damaged, the dial plate 2 as a whole must not be deformed. For this purpose, the base plate 3 is made large in thickness and hence the thickness near the center part of the dial plate 2 becomes increased. Thus, the timepiece as a whole becomes increased in thickness thereby creating an important problem in the prior techniques that provision must be made of a solar battery timepiece which is thin in thickness.

An object of the invention, therefore, is to provide a solar battery timepiece which is relatively thin, small in size, simple in construction, shock resistant and reliable in operation.

A feature of the invention is the provision of a solar battery timepiece comprising a module, a base plate arranged on said module and a solar battery cell disposed on said base plate, electric current produced by said solar battery cell being conducted to said module, characterized in that the timepiece has an insulating flexible sheet provided thereon with a print wiring and interposed between said base plate and said solar battery cell, and a dial ring secured to the peripheral edge of said base plate.

This invention will now be described in greater detail with reference to the accompanying drawings, wherein.

Figure 1:
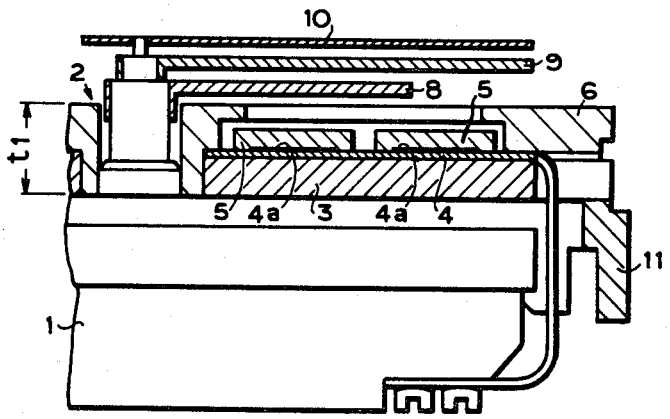
FIG. 1 (PRIOR ART)
FIG. 1 is a partial longitudinal sectional view of main parts of a conventional solar battery timepiece.
Figure 2:
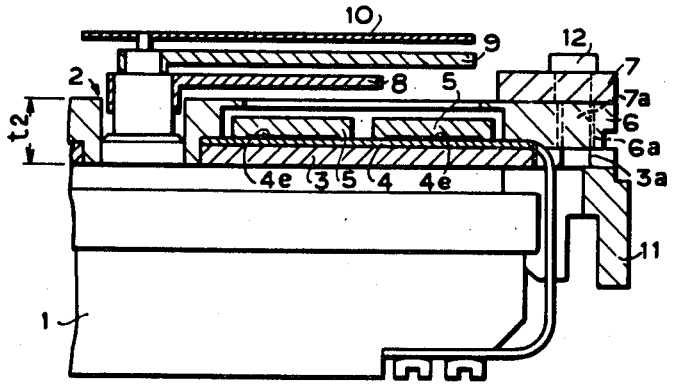
FIG. 2 is a longitudinal sectional view of main parts of one embodiment of a solar battery timepiece according to the invention.
Figure 3:
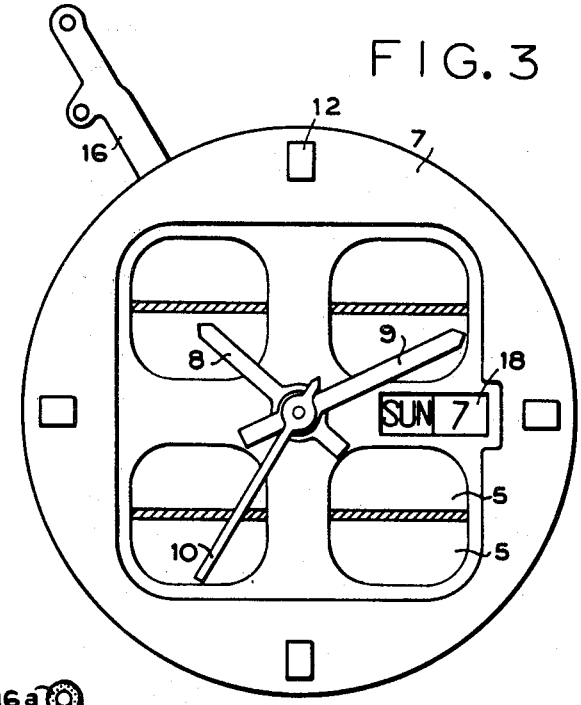
FIG. 3 is its plan view.

Referring to FIGS. 2 and 3, on the upper surface of a module 1 is arranged a base plate 3 to the upper surface of which is secured an insulating flexible sheet 4 which is provided on its upper surface with a wiring pattern 4*e* for electrically connecting a plurality of solar battery cells 5 to the module 1. On the upper surface of the flexible sheet 4 are fixedly mounted the above mentioned solar battery cells 5 and a dial plate frame 6. The base plate 3 is provided at its peripheral edge with a plurality of holes 3*a* through which are extended several legs 7*a* secured to the lower surface of a dial ring 7. Free ends of these legs 7*a* are secured to the base plate 3 by caulking so as to firmly secure the dial ring 7 to the base plate 3.

In order to make the antimagnetic property of the module 1 high, the base plate 3 may be formed of a magnetically permeable material for the purpose of magnetic shielding.

Among an hour hand 8, minute hand 9 and second hand 10, at least hour hand 8 rotates inside of the dial ring 7, so that the thickness of the dial ring 7 is not influenced by the total thickness of the timepiece. Conversely, since the dial ring 7 is secured to the peripheral edge of the base plate 3, the mechanical strength of the dial plate 2 as a whole is increased. As a result, the base plate 3 which has a reduced thickness can maintain the mechanical strength of the dial plate 2. Thus, a thickness $t_2$ near the center part of the dial plate 2 becomes small thereby providing a thin solar battery timepiece.

The dial ring 7 may be composed of a metal ring which is similar to the conventional dial plate. Thus, it is possible to imprint letters and marks on the surface of the dial ring 7 in an easy manner.

As described above, in the solar battery timepiece according to the invention, the base plate 3 arranged on the upper surface of the module 1 is provided at its peripheral edge with the dial ring 7 secured thereto, so that the base plate 3 is prevented from being deformed due to shocks subjected thereto. As a result, the solar battery cells 5 are also prevented from being damaged. Thus, it is possible to make the base plate 3 thin. In addition, the dial ring 7 is separated from the base plate 3 so that various designs may be made on the dial ring 7.

Figure 4:
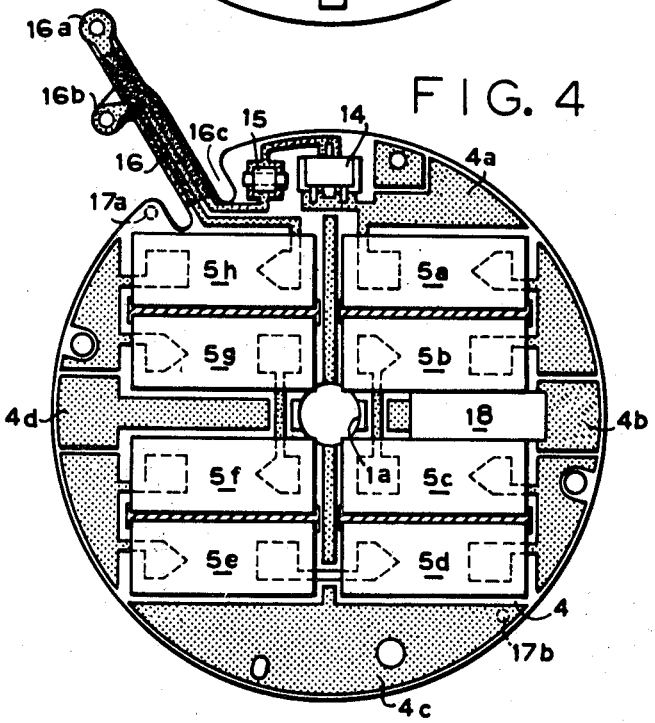
FIG. 4 is a plan view similar to FIG. 3 with the shown in FIG. 3 removed.

In FIG. 4 are shown main parts of the solar battery timepiece according to the invention by removing the surface portions shown in FIG. 3. The flexible sheet 4 is substantially circular and provided at its center with a hole 1*a* through which is extended a hand shaft (not shown). The flexible sheet 4 is provided thereon with a copper foil to which are secured 8 solar battery cells 5*a* to 5*h*. These solar battery cells are arranged around the center hole and electrically connected in series.

Those semi-circular portions 4*a* to 4*d* of the outer peripheral edge of the flexible sheet 4 which are remaining after the arrangement of the solar battery cells 5*a* to 5*h* provide a space required for arranging electrical circuit element. In the present embodiment, on the outer peripheral portion 4*a* are arranged a reverse current blocking diode 14 and a current limiting resistor 15 which are secured to the flexible sheet 4 by solder and electrically connected in series with the solar battery cells 5*a* to 5*h*.

The flexible sheet 4 is provided with a connection terminal 16 adapted to be connected to an electric battery and timepiece driving circuit (not shown) arranged at the side of the module 1. The connection terminal 16 is extended through a notch (not shown) formed in the outer peripheral edge of the module 1 and electrically connected to a base plate (not shown) of the timepiece driving circuit arranged at that portion of the module 1 which is opposed to the dial plate 2 by means of screws through holes 16*a*, 16*b* formed in the connection terminal 16. In order to prevent the connection terminal 16 from being made electrically contact with the module 1 when the connection terminal 16 is extended through the module 1, the connection terminal 16 is coated with an insulating layer as shown by inclined dotted lines.

It is preferable to project the connection terminal 16 from any one of the outer peripheral portions 4*a* to 4*d* of the flexible sheet 4 having a space which can provide a notch 16*c* for allowing the connection terminal 16 to be easily bent.

To the lower surface of the flexible sheet 4 is secured a base plate such as a magnetic shield plate etc. (not shown) for the purpose of mechanically reinforcing the flexible sheet 4. To the base plate are soldered legs 17*a*, 17*b* projected from the dial ring 7 for the purpose of securing the base plate to the module 1. The leg 17*a* is arranged near the connection terminal 16 so as to prevent the connection terminal 16 from being displaced in the case of mounting the module 1 on the timepiece.

The flexible sheet 4 is provided with a calendar indication window 18 which functions to widely space apart the solar battery cells 5*b* and 5*c* from each other. The lengthwise side of each of the solar battery cells 5*a* to 5*h* is arranged in parallel with the lengthwise side of the calendar indication window 18 so as to provide a space for allowing the calendar indication window 18 to be formed therein.

In addition, the 8 solar battery cells 5*a* to 5*h* are made rectangular in shape and arranged on the flexible sheet 4 such that the corners of the solar battery cells 5*a*, 5*d*, 5*e*, 5*h* are located under a balanced condition on the circular outer peripheral edge of the flexible sheet 4. As a result, the timepiece can be made thin in thickness and small in size without forcedly making the number of the solar battery cells 5 and illumination area small.

The flexible sheet 4 is provided on its upper surface with a circular insulating dial plate 2. The dial plate 2 comprises a window which corresponds to the outer contour of the solar battery cells 5*a* to 5*h*, a calendar indication window frame corresponding to the calendar indication window 18, a hole corresponding to the center hole 1*a* through which is extended the hand shaft and a scale, trade name, maker's name etc., imprinted thereon.

On the center part of the flexible sheet 4 are arranged a plurality of solar battery cells 5 and at least one part of the outer peripheral edge thereof are arranged electrical circuit elements other than the solar battery cell, such as a reverse current blocking diode, current limiting resistor etc. As a result, it is not necessary to provide a space which has been required for the conventional timepiece for the purpose of enclosing such electrical circuit elements therein. In addition, a plurality of solar battery cells are arranged on the flexible sheet 4 and the remaining dead space is effectively utilized, so that the dial plate itself does not become large in thickness and size. As a result, the solar battery timepiece as a whole becomes reduced in thickness and small in size.

Particularly in the timepiece provided with the calendar indication window, if the electrical circuit elements such as the reverse current blocking diode, current limiting resistor etc. are arranged on that portion of the flexible sheet 4 which is nearer to the peripheral edge thereof than the calendar mechanism, the electrical elements are not superimposed on the calendar mechanism, thereby making the timepiece thin.

In the timepiece according to the invention, the steps of mounting the dial plate 2 and module 1 are effected in the same manner as in the case of the conventional timepiece, but the electrical connection can be made with screws with the aid of the band-shaped connection terminal 16 made integral with the flexible sheet 4. As a result, the electrical connections can simply be secured to and removed from the base plate. There is no risk of the wiring being broken by shocks subjected thereto during the operation or carrying of the timepiece. Thus, the timepiece according to the invention is highly reliable.

Figure 5:
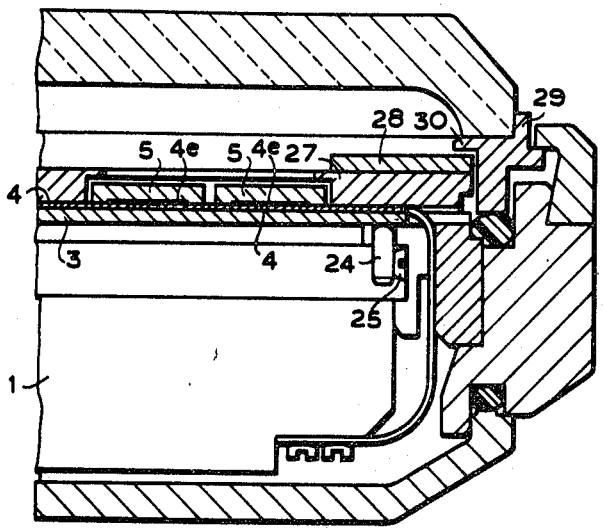
FIG. 5 is a longitudinal sectional view of main parts of another embodiment of a solar battery timepiece according to the invention.
Figure 6:
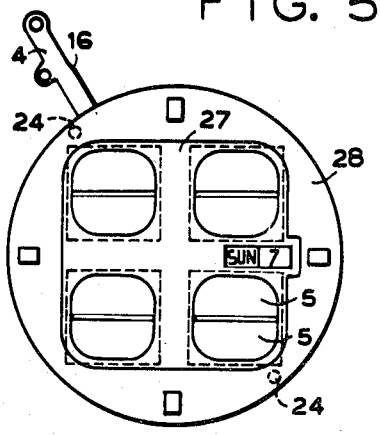
FIG. 6 is a plan view of the solar battery timepiece as a whole shown in FIG. 5.

In FIGS. 5 and 6 is shown another embodiment of the solar battery timepiece according to the invention. In the present embodiment, reference numeral 27 designates a dial ring frame.

The base plate 3 is provided on its upper surface with the flexible sheet 4 and on its lower surface with legs 24 secured to the module 1. Against the legs 24 are urged screws 25 so as to firmly secure the base plate 3 to the module 1. The flexible sheet 4 is provided on its upper surface with the wiring pattern 4*e* for supplying electric current produced by the solar battery cells 5 to the module 1.

The solar battery cells 5 are soldered through the wiring pattern 4*e* to the flexible sheet 4. The dial ring frame 27 provided thereon with a dial ring 28 is secured to the flexible sheet 4 so as to surround the solar battery cells 5.

Figure 7:
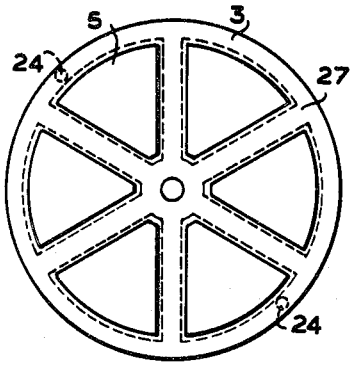
FIG. 7 is a plan view of a modified embodiment of the solar battery timepiece shown in FIG. 6.

In FIG. 7 is shown a modified embodiment of the timepiece shown in FIG. 6. In the present embodiment, the flexible sheet 4 is omitted and the solar battery cells 5 are directly secured to the upper surface of the base plate 3. The electric current produced in the solar battery cells 5 is supplied through an electric conductive wire (not shown) provided on the lower surface of the base plate 3 to the module 1.

Even in the present embodiment, the solar battery cells 5 are not arranged on those portions of the base plate 3 where the legs 24 are located.

As seen from the above, in the present embodiment, the solar battery cells 5 are arranged on those portions of the base plate 3 where the legs 24 for securing the base plate 3 to the module 1 are absent, so that even when shocks are subjected to the module 1 and hence the dial ring frame 27 or the dial ring 28 is urged against a shoulder portion 30 of a glass ring 29 and hence a part of the base plate 3 including the leg 24 becomes deformed, there is no risk of the solar battery cells 5 being separated nor broken. Thus, the damage of the solar battery cells 5 due to shocks which has been encountered with the prior techniques can be eliminated.

Figure 8:
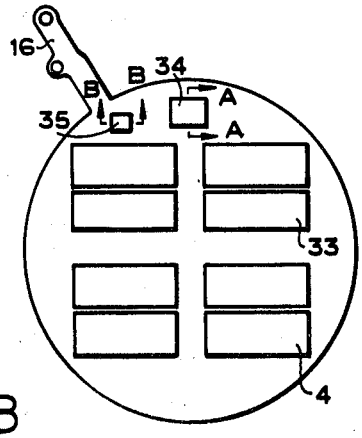
FIG. 8 is a plan view of a further embodiment of a solar battery timepiece according to the invention.
Figure 9:
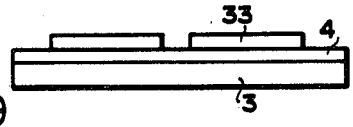
FIG. 9 is its side elevational view.

In FIGS. 8 and 9 is shown a further embodiment of the solar battery timepiece according to the invention. In the present embodiment, the insulating flexible sheet 4 is formed of a heat resistant polyimide resin and provided thereon with the wiring pattern (not shown) to which are secured various kinds of electric circuit elements 33, 34, 35 by soldering, thereby constituting a dial plate. Among these electric circuit elements, the elements 34 and 35 are of the order of 1 mm in size.

Also, in the present embodiment, the insulating flexible sheet 4 is provided at its lower surface with the metal base plate 3 secured thereto in a usual manner for the purpose of maintaining the flexible sheet 4 in its flat configuration and of exhibiting the above-mentioned advantages.

Figure 10:
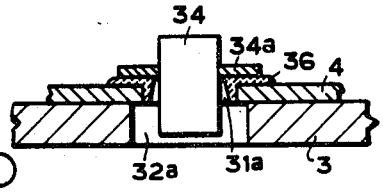
FIG. 10 is a section taken on line A—A of FIG. 8.

The electric circuit element 34 is provided with a mounting terminal plate 34*a* as shown in FIG. 10. The insulating flexible sheet 4 is provided with a hole 31*a* through which is projected the electric circuit element 34 with an air gap formed between the element 34 and the perimeter of the hole 31*a*. The metal base plate 3 secured to the lower surface of the insulating flexible sheet 4 is provided with a hole 32*a* which is larger than the hole 31*a*. If the electric circuit element 34 is secured to the insulating flexible sheet 4 by solder 36, about one half of the electric circuit element 34 is enclosed in the insulating flexible sheet 4 and the base plate 3, so that the upwardly projection portion of the electric circuit element 34 is reduced to one half thereof. As a result, the electric circuit element 34 can be secured to the insulating flexible sheet 4 within a limited thickness, so that it is possible to make the timepiece small in size. In addition, even when the solder 36 flows toward the hole, the hole 32*a* formed in the metal base plate 3 and larger than the hole 31*a* formed in the insulating flexible sheet 4 prevents the solder 36 from making contact with the metal base plate 3 thereby reliably securing the electric circuit element 34 to the insulating flexible sheet 4 without shortcircuiting the solder 36 with the metal base plate 3.

Figure 11:
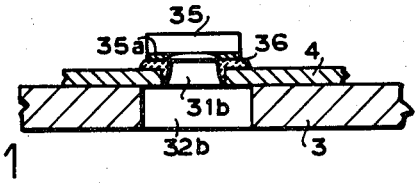
FIG. 11 is a section taken on line B—B of FIG. 8.

In the case of securing the superminiature electric circuit element 35 to the insulating flexible sheet 4 by the solder 36 as shown in FIG. 11, the insulating flexible sheet 4 is provided with a hole 31*b* which is made as large as possible with a minimum portion required for soldering remaining. The metal base plate 3 secured to the insulating flexible sheet 4 is provided with a hole 32*b* which is larger than the hole 31*b*. The electric circuit element 35 is provided at its lower part with a terminal plate 35*a* which is secured to the electrode pattern coated on the insulating flexible sheet 4 by means of the solder 36. Also, in the present embodiment, the electric circuit element 35 is prevented from being shortcircuited with the metal base plate 3.

As seen from the above, the insulating flexible sheet printed thereon with the wiring pattern is provided with the hole and the metal base plate secured to the insulating flexible sheet is provided at a position corresponding to the former hole with the hole which is larger than the former hole. As a result, in the case of securing the superminiature electric circuit element to the wiring pattern of the insulating flexible sheet, there is no risk of the electric circuit element being shortcircuited with the metal base plate by the flow of solder. Thus, the super-miniature electric circuit element can reliably be connected to the insulating flexible sheet.

Figure 12:
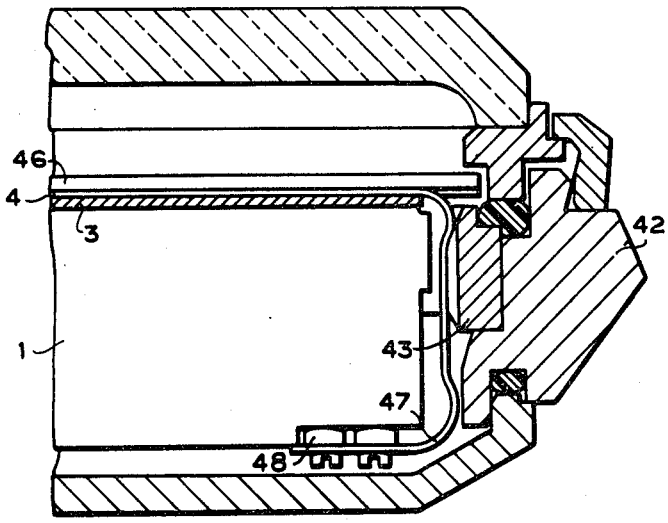
FIG. 12 is a partial sectional view of a still further embodiment of a solar battery timepiece according to the invention.

In FIG. 12 is shown a still further embodiment of the invention. In the present embodiment, use is also made of a unit composed of a module 1, a base plate 3 located on the module 1, and an insulating flexible sheet 4 on which is disposed an electric circuit element 46. A part of the insulating flexible sheet 4 is projected therefrom as a terminal 47. The free end of the terminal 47 is connected through a connection part or electric circuit element 48 to the module 1.

Figure 13:
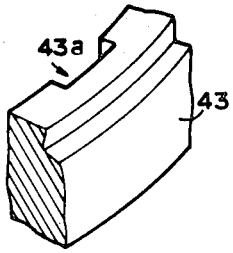
FIG. 13 is a partial perspective view of a main part shown in FIG. 12.

A timepiece case 42 is made integral through an supporting ring 43 with the module 1. The supporting ring 43 is provided at its inner periphery with a groove 43*a* as shown in FIG. 13. The groove 43*a* functions to permit the terminal 47 to pass therethrough.

In the case of incorporating the module 1 into the case 42, at first the module 1 is united with the supporting ring 43 and then the terminal 47 of the unit is inserted into the groove 43*a* of the supporting ring 43 and finally the module 1 is incorporated into the case 42.

The terminal 47 is bent into an arcuate form having a large radius so as to prevent the terminal 47 from being folded and hence broken. As a result, the arcuate terminal 47 tends to make contact with the case 42. But, the presence of the supporting ring 43 ensures an interruption between the terminal 47 and the case 42.

Figure 14:
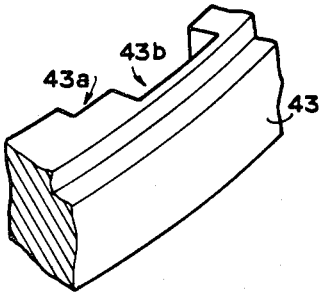
FIG. 14 is a partial perspective view of a modified embodiment of the main part shown in FIG. 12.

In FIG. 14 is shown a modified supporting ring 43 which can be used when the terminal 47 is provided at its front end or intermediate portion with a part of the electric circuit element 46 or the connection element 48. In the present embodiment, the supporting ring 43 is provided at its inner periphery with a shallow groove 43*a* enclosing the terminal 47 and a deep groove 43*b* enclosing the connection element 48. The deep groove 43*b* allows a relatively large circuit element secured to the terminal 47 to pass, while the shallow groove 43*a* restricts the curved portion of the terminal 27.

As seen from the above, the radially bulged portion of the terminal 47 to be connected to the module 1 is restricted by the groove 43*a* provided in the supporting ring 43 in the case of adding another unit to the unit inclusive of the module 1, so that there is no risk of the terminal 27 being shortcircuited with the case 42 during or after incorporation of another unit into the unit inclusive of the module 1. In addition, the intermediate frame 43 is provided with two grooves in a stepwise manner, one of the grooves restricting the terminal from the case and the other groove allowing the electrical circuit element to pass therethrough, so that another unit can easily and reliably be connected to the existing unit.

What is claimed is:

1. A circuit apparatus for use in an electronic or solar timepiece comprising:

(a) a base metal plate having an aperture (32*a*, 32*b* ) therein;

(b) an insulated flexible sheet (4) secured to and overlying said base metal plate, and having conductive patterns thereon and an aperture (31*a*, 31*b*) therein;

(c) said aperture in said insulated flexible sheet having a size less than that of said aperture in said base metal plate; and formed so that said apertures are in overlapping registry when viewed from above;

(d) an electric circuit element (34, 35) having a terminal (34*a*, 35*a*), and secured at the periphery of said aperture in said insulated flexible sheet by a means for securing; and (e) said terminal having a size greater than that of said aperture in said insulated flexible sheet.

2. The circuit apparatus of claim 1 wherein the aperture in said insulated flexible sheet has a size which is greater than the cross sectional size of the electronic circuit element and less than the size of the aperture in the base metal plate.

3. The circuit apparatus of claims 1 or 2 wherein said terminal has an opening therein, said terminal is located over the flexible sheet with the electric circuit element projecting through the opening in the terminal.

4. The circuit apparatus of claim 3 wherein the means for securing is solder.

* * * * *